US008833769B1

(12) United States Patent
Hilvitz

(10) Patent No.: US 8,833,769 B1
(45) Date of Patent: Sep. 16, 2014

(54) COLLAPSIBLE GAME TABLE TOP AND GAME BOARD

(71) Applicant: Brent Hilvitz, Englewood, CO (US)

(72) Inventor: Brent Hilvitz, Englewood, CO (US)

( * ) Notice: Subject to any disclaimer, the term of this patent is extended or adjusted under 35 U.S.C. 154(b) by 0 days.

(21) Appl. No.: 14/078,906

(22) Filed: Nov. 13, 2013

Related U.S. Application Data

(60) Provisional application No. 61/854,837, filed on May 2, 2013.

(51) Int. Cl.
*A63F 3/00* (2006.01)

(52) U.S. Cl.
USPC ..... 273/285; 273/283

(58) Field of Classification Search
USPC ..... 273/285, 286
See application file for complete search history.

(56) References Cited

U.S. PATENT DOCUMENTS

| | | | | |
|---|---|---|---|---|
| 3,181,179 | A * | 5/1965 | Roddey, Jr. | 5/497 |
| 3,948,528 | A * | 4/1976 | Goodman et al. | 273/286 |
| 4,709,928 | A | 12/1987 | Willingham | |
| 4,777,894 | A * | 10/1988 | Joyce | 112/475.08 |
| 4,934,939 | A * | 6/1990 | Bonneville | 434/247 |
| 5,024,262 | A | 6/1991 | Huang | |
| 5,647,595 | A * | 7/1997 | Knickerbocker | 273/118 R |
| 5,695,191 | A * | 12/1997 | Frost | 273/260 |
| 5,839,976 | A * | 11/1998 | Darr | 473/414 |
| 5,996,999 | A * | 12/1999 | Casely | 273/148 R |
| 6,120,030 | A | 9/2000 | Chou | |
| 6,163,889 | A | 12/2000 | Tate | |
| 6,196,543 | B1 * | 3/2001 | Cornett | 273/148 R |
| 6,776,414 | B1 | 8/2004 | Messac | |
| 6,945,533 | B1 * | 9/2005 | Salerno | 273/309 |
| 7,147,225 | B2 | 12/2006 | Navarro | |
| 7,575,240 | B1 | 8/2009 | Vodel | |
| 8,342,226 | B2 | 1/2013 | Zheng | |
| 2004/0163603 | A1 * | 8/2004 | Newton | 119/28.5 |
| 2010/0100269 | A1 * | 4/2010 | Ekhaguere et al. | 701/26 |
| 2012/0073770 | A1 | 3/2012 | Zheng | |

FOREIGN PATENT DOCUMENTS

DE 20101910 U1 * 6/2001

* cited by examiner

*Primary Examiner* — Vishu Mendiratta

(57) ABSTRACT

A portable gaming top which can serve as a vehicle sunshade, with multiple accessory attachments, which may be folded onto itself to facilitate portability, enabling the playing of multiple card and board games anywhere there is a flat surface. The game table top is designed to be used as a smooth table covering or play surface for various games, including card games where a smooth surface is ideal being able to deal cards; board games where convenience of storage and ability to move game pieces on a smooth surface is ideal. The game table top is designed to be twisted and folded upon itself into a smaller form factor to enable convenient storage and transport. The game table top also includes fasteners such as hook-and-loop fasteners or straps to be used to attach additional features. The game table includes a carrying case with pockets to hold additional accessories.

8 Claims, 11 Drawing Sheets

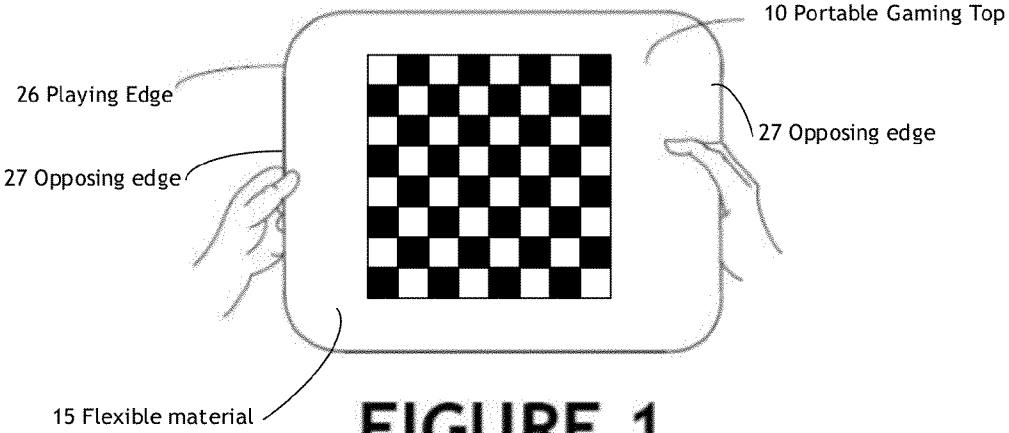
FIGURE 1
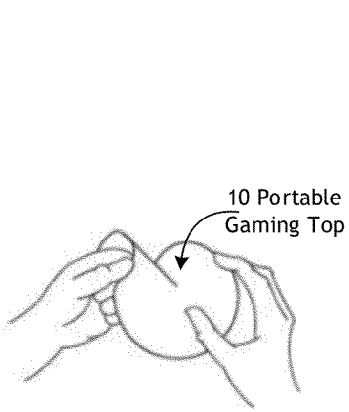
FIGURE 2A
FIGURE 2B
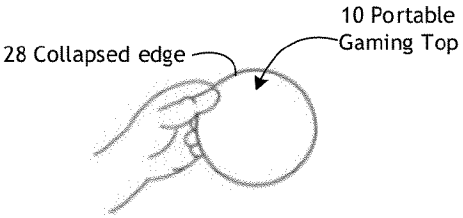
FIGURE 2C

COLLAPSIBLE GAME TABLE TOP AND GAME BOARD

CROSS-REFERENCE TO RELATED APPLICATIONS

This application is related to and claims priority to U.S. Provisional Application No. 61/854,837, entitled "COLLAPSIBLE GAME TABLE TOP AND GAME BOARD" (Hilvitz) filed on May 2, 2013.

FIELD OF USE

The present invention relates to a gaming surface which can be used in the play of various games, and more particularly, to a portable gaming surface that is imprinted for play, such as card games or common board games.

BACKGROUND OF THE INVENTION

Prior applications of portable gaming tops tend to be on the unwieldy side as they also include the table itself, requiring room, and are not readily transportable. As a result, they also tend to be game specific. There are currently no universal, portable gaming tops which fold on themselves, or roll up into a small, portable form.

U.S. Pat. No. 7,575,240 (Vodel) discloses a folding game table having a collapsible construction is disclosed. The folding game table has a pair of table members interconnected with at least one hinge and movable between an extended position and a folded position. At least one game template is configured to be removably positioned on at least one of the pair of table sections for game play thereon.

U.S. Pat. No. 6,776,414 (Messac) discloses a universal game board having a plurality of pieces to configure various game boards for the game to be played. Stacked plates are used to vary the elevation of the playing surface as needed. Board bases are maintained by table frame assemblies and are configured to allow board bases to be secured adjacently for doubling, tripling, or quadrupling the area of the playing surface.

U.S. Pat. No. 6,120,030 (Chou) is a tabletop having multiple indoor game layouts includes a base member and a cover member. The base has a bottom wall provided with a first indoor game layout, and a surrounding wall extending upwardly from a periphery of the bottom wall. The cover member is mounted detachably on the surrounding wall and has one side provided with a second indoor game layout. The tabletop further includes a board member disposed horizontally and removably inside the base member and provided with a third indoor game layout.

U.S. Pat. No. 4,709,928 (Willingham) is a circular game board comprising a circular playing surface bounded by a generally tubular member affixed around the periphery of the playing surface. An elongate spring-like member is disposed in the tubular member, and an appropriate device is used for securing the ends of the spring-like member together so as to form a ring. This spring-like member is in the form of a length of thin metal or plastic, with ends joined together after insertion into the tubular member to form the ring to keep the playing surface taut.

What is needed is a portable gaming top that is compatible with many different card and board games, is easy to carry around in that it can be stored in a purse or pocket, can be folded into a small form factor that can be transported along with gaming accessories, and is multi-functional, thereby facilitating ease of storage and portability.

SUMMARY OF THE INVENTION

The collapsible game table top and game board of the present invention addresses all of these needs.

The gaming top of the present invention includes an imprinted gaming surface that enhances the play of a game, a perimeter of the gaming surface, and a flexible material disposed within the perimeter.

The perimeter is collapsible into a smaller form factor and the flexible material facilitates the folding of the portable gaming top onto itself.

Two of said opposing edges of the perimeter are essentially parallel when said perimeter is not collapsed, and the shape of the smaller form factor is essentially circular when said perimeter is collapsed.

A primary purpose of the gaming top of the present invention is to be used as a collapsing, portable, gaming surface which may be used for a variety of card games and board games, while serving as a vehicle sunshade. There are also a variety of accessories which may be attached, via magnets or hook-and-loop fasteners (e.g.—Velcro®, which is a registered trademark of Velcro, S.A.) to the portable gaming top of the present invention for specific games, such as Texas Hold'em, stud poker, blackjack, chess, backgammon, Scrabble®, Monopoly®, Clue®, etc.

Also, the gaming top of the present invention provides for means to attach to a flat surface, such as suction cups attached to the outer edge, enabling the top to be attached to a hot tub or other surface, hook-and-loop type fasteners, straps, and the like incorporated into the playing surface.

Another alternative embodiment of the portable gaming top of the present invention involves having the surface of the gaming top to be made from a magnetic cloth, and the use of magnetic gaming accessories (cards or gaming pieces).

Still another embodiment would have a water proof playing surface, with an edge which enables the gaming top to float, in order to prevent the top from becoming wet and unusable.

In yet another preferred embodiment of the gaming top of the present invention, the device can be used as a sunshade and a gaming top. Instead of a reflective side for use as a vehicle sunshade, there can be a variety of gaming surfaces printed either on one surface or on both surfaces of the gaming top, enabling the user to simply turn the gaming top of the present invention over and reverse the chip wells to play other games.

For a complete understanding of the portable gaming top of the present invention, reference is made to the following summary of the invention, detailed description and accompanying drawings in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention.

BRIEF DESCRIPTION OF THE DRAWINGS

FIG. 1 depicts a first preferred embodiment of the gaming top of the present invention.

FIGS. 2A, 2B, and 2C depict the gaming top of FIG. 1 being twisted and collapsed by a user into a smaller compact shape for storage purposes into a purse or pocket.

DETAILED DESCRIPTION OF THE PREFERRED EMBODIMENTS

Figure 3A:
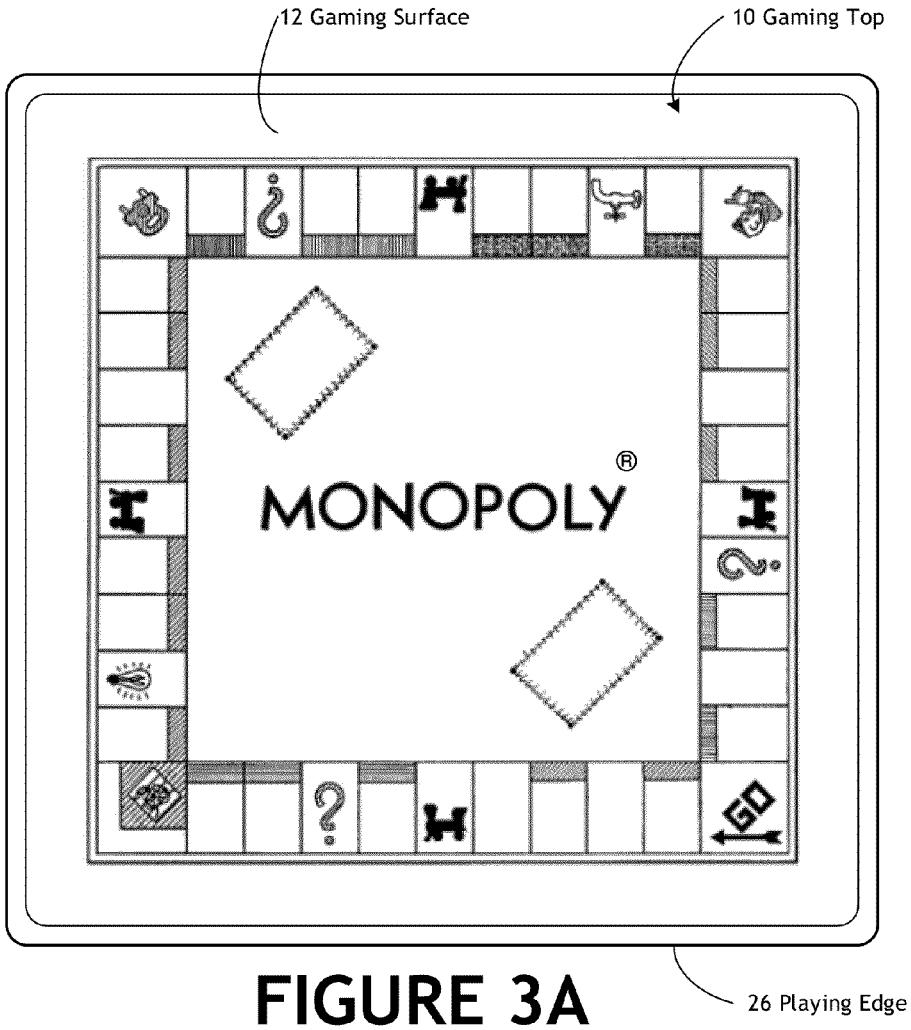
FIG. 3A depicts still another preferred embodiment of a gaming top of the present invention, the gaming top being imprinted onto a magnetic gaming surface of FIG. 1.

Referring now to the drawings, FIG. 1 depicts a first preferred embodiment of the portable gaming top [10] of the present invention, showing the gaming surface [12] of a chess board. The portable gaming top [10] is for use as a smooth table covering or surface for playing a multitude of games, such as card games where a smooth dealing surface is needed, or board games where ease of storage and the ability to move the game pieces about without interference from the underlying surface is desired.

The gaming top of the present invention includes the imprinted gaming surface [12] that enhances the play of a game, a perimeter of the gaming surface [12], and a flexible material [15] disposed within the perimeter.

The perimeter of the gaming top is the playing edge [26]. The playing edge [26] is collapsible into a smaller form factor and the flexible material [15] facilitates the folding of the gaming top [10] onto itself.

The playing edge [26] is sewn into the flexible material stretched across the perimeter of the gaming top [10] and is preferably made of spring steel, or other durable, flexible material is sewn, which enables the gaming top [10] to be folded upon itself for purposes of transport and storage. The gaming surface [12] is made from spandex or similar cloth, or any other material, and is stretched over the edge [28] and sewn. The edge [28] is made of a non-slip material which will prevent the top from shifting around when placed upon a surface, such as a table top or floor.

Two of said opposing edges [27] of the perimeter [26] are essentially parallel to each other when said perimeter is not collapsed, and the shape of the smaller form factor is essentially circular when said perimeter [28] is collapsed (see FIG. 2C). FIGS. 2A, 2B, and 2C depict the portable gaming top of FIG. 1 being twisted and collapsed by a user into a smaller compact and essentially circular shape for storage purposes into a purse or pocket.

Figure 3B:
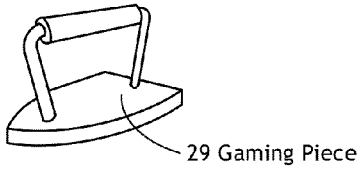
FIG. 3B depicts a magnetic gaming piece for use with the magnetic gaming top of FIG. 3A.

FIG. 3A depicts a second preferred embodiment of the gaming top of the present invention, said gaming top being a magnetic Monopoly® board imprinted onto a magnetic gaming top of FIG. 1, and FIG. 3B depicts a magnetic gaming piece for use with the magnetic gaming top of FIG. 3A. At least a portion of the fabric of the portable gaming top [10] is made from a material having magnetic properties, allowing the adhesion of magnets, without increasing the bulk, or compromising the flexibility of the top with the game accessories having rare earth magnets embedded inside of them to allow them to stick to the fabric. Examples of some magnetic fabric materials may be found at U.S. Pat. No. 7,147,225 (Navarro) and U.S. Pat. No. 6,163,889 (Tate).

Figure 4A:
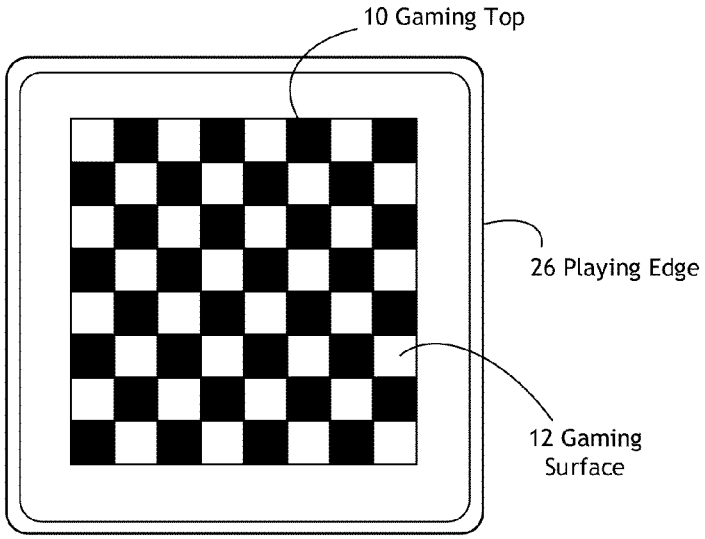
FIGS. 4A, 4B, 4C, and 4D depict several preferred embodiments of the gaming top of the present invention of FIG. 1.
Figure 4B:
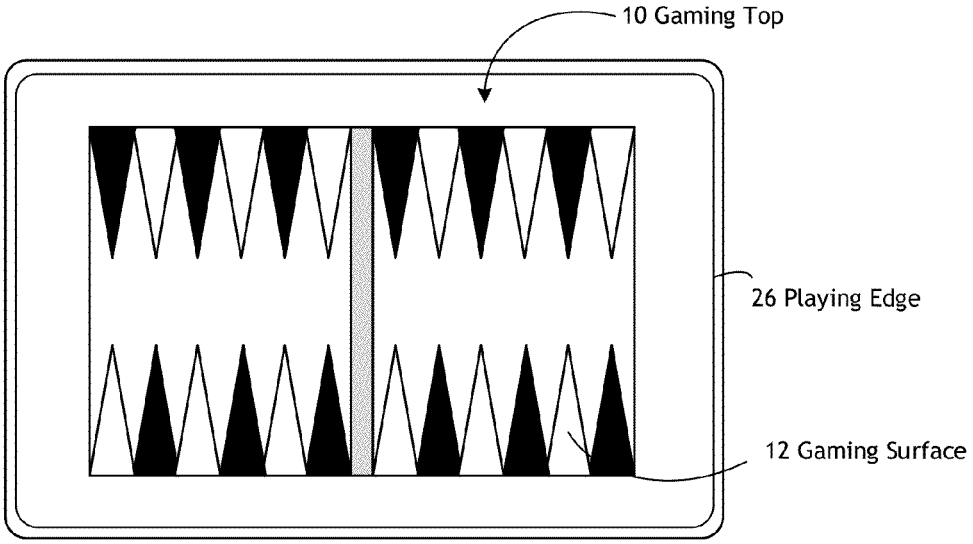
Figure 4C:
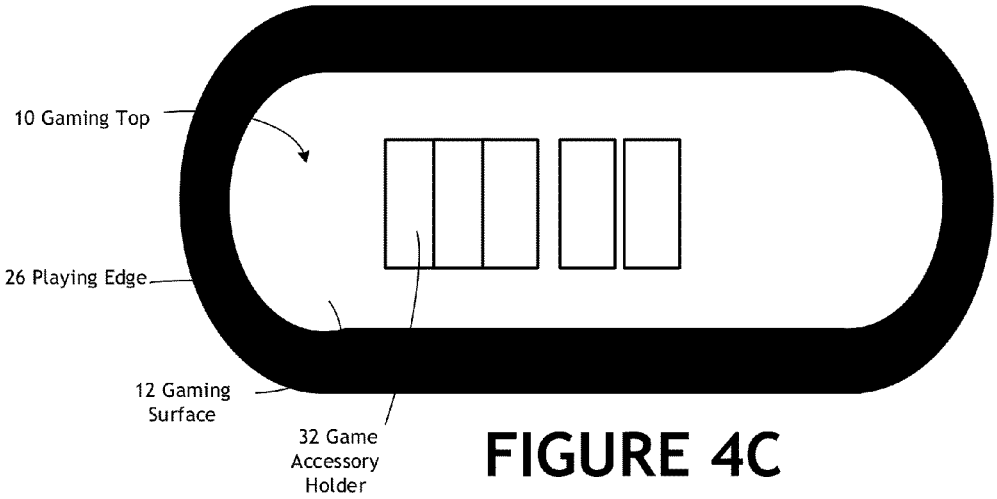
Figure 4D:
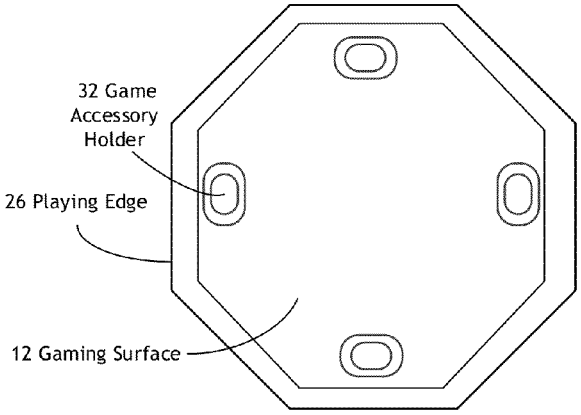

FIGS. 4A, 4B, 4C, and 4D depict several preferred embodiments of the portable gaming top [10] of the present invention, FIG. 4A being a chess or checker board, FIG. 4B being a backgammon board, FIG. 4C being a poker table for playing Texas Hold'em, and FIG. 4D being a table for playing straight poker. Additionally, game accessory holders [28] may be attached to the gaming surface [12] using hook-and-loop fasteners, straps, magnets, or other means.

Figure 5:
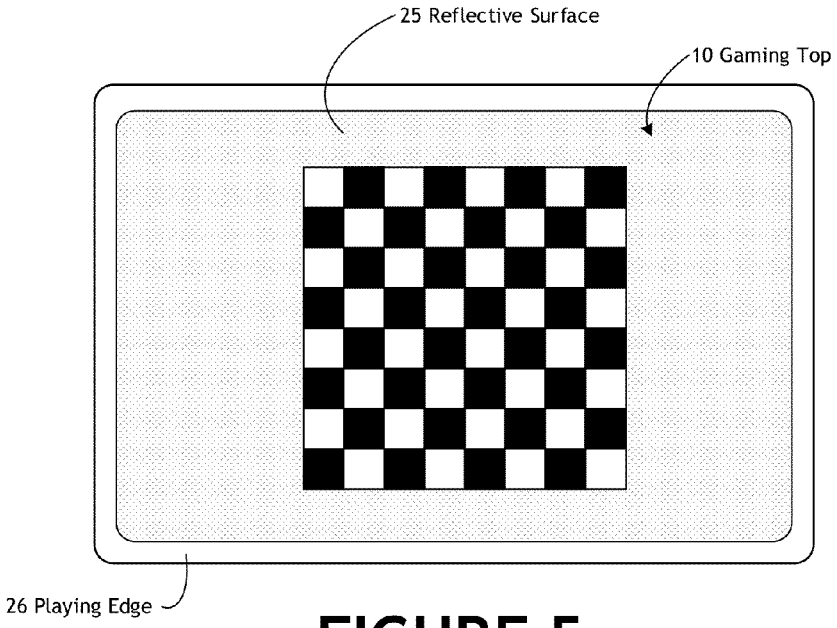
FIG. 5 depicts another preferred embodiment of the gaming top of the present invention, the gaming top having a reflective surface on one side of the gaming top of FIG. 1 which enables the portable gaming top to be used as an automobile sun shade.

The portable gaming top of the present invention [10] can also have a reflective surface [25] enabling the portable gaming top [10] of the present invention to be used as a vehicle sunshade as depicted in FIG. 5.

Figure 6:
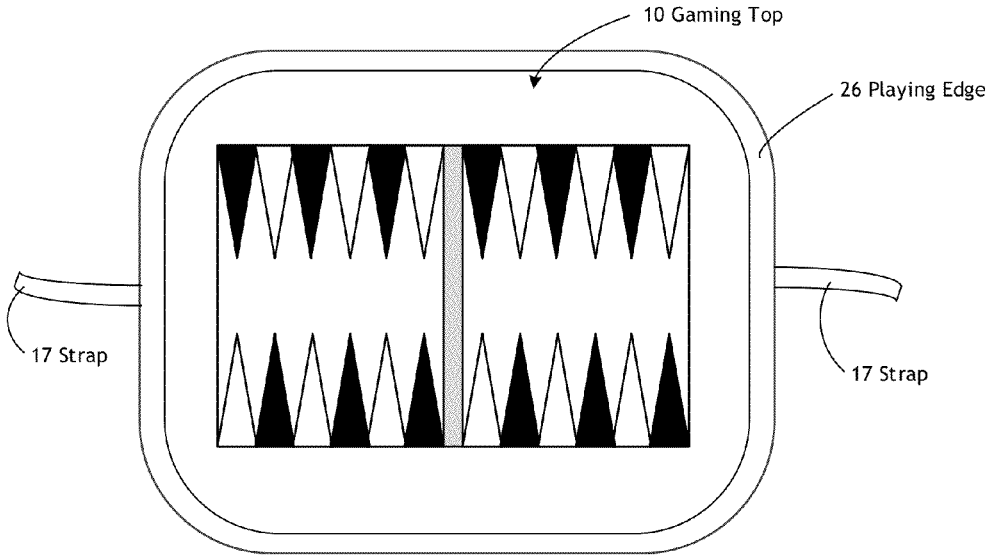
FIG. 6 depicts yet another preferred embodiment of the portable gaming top of FIG. 1 with a pair of straps to affix the gaming top to a table or similar surface.

FIG. 6 depicts yet another preferred embodiment of the portable gaming top of FIG. 1. The imprinted gaming surface is a backgammon game and the gaming top includes a pair of straps to affix the gaming top to a table or similar surface.

One or more straps [17], or other affixing means, are attached to the portable gaming top [10] and used to secure the portable gaming top [10] to a surface, such as a table. The strap [17], or other fixing means, can also be used to secure the portable gaming top of the present invention [10] when it is collapsed as in FIG. 6C to prevent said gaming top from opening unexpectedly.

Figure 7A:
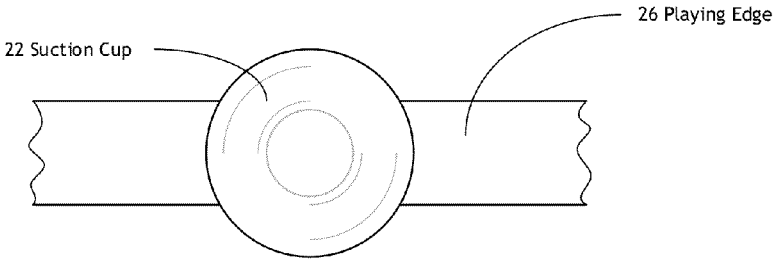
FIGS. 7A and 7B depict an example of a suction cup that may be attached to the edge of the portable gaming top.
Figure 7B:
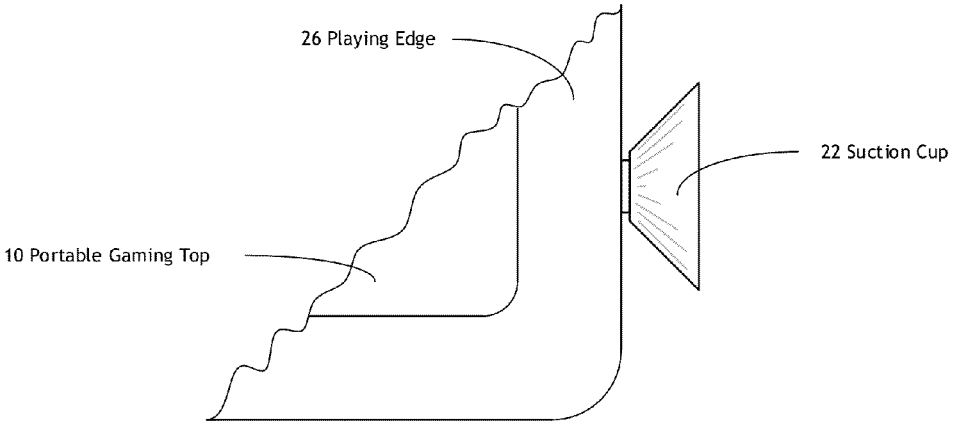

FIG. 7 depicts still yet another preferred embodiment of the portable gaming top of FIG. 1. The gaming surface [12] and edge [26] are made from waterproof material to prevent the surface from becoming stained or otherwise unusable due to spills. Also, suction cups [22] are attached to the edge [26], so as to facilitate attaching the portable gaming top [10] to smooth surfaces. The suction cups [22] also enable the portable gaming top [10] to be used in pools, hot tubs, and bath tubs. The edge [26] may also contain or be made from a buoyant material to enable the portable gaming top [10] to float for use in a pool or hot tub.

Figure 8:
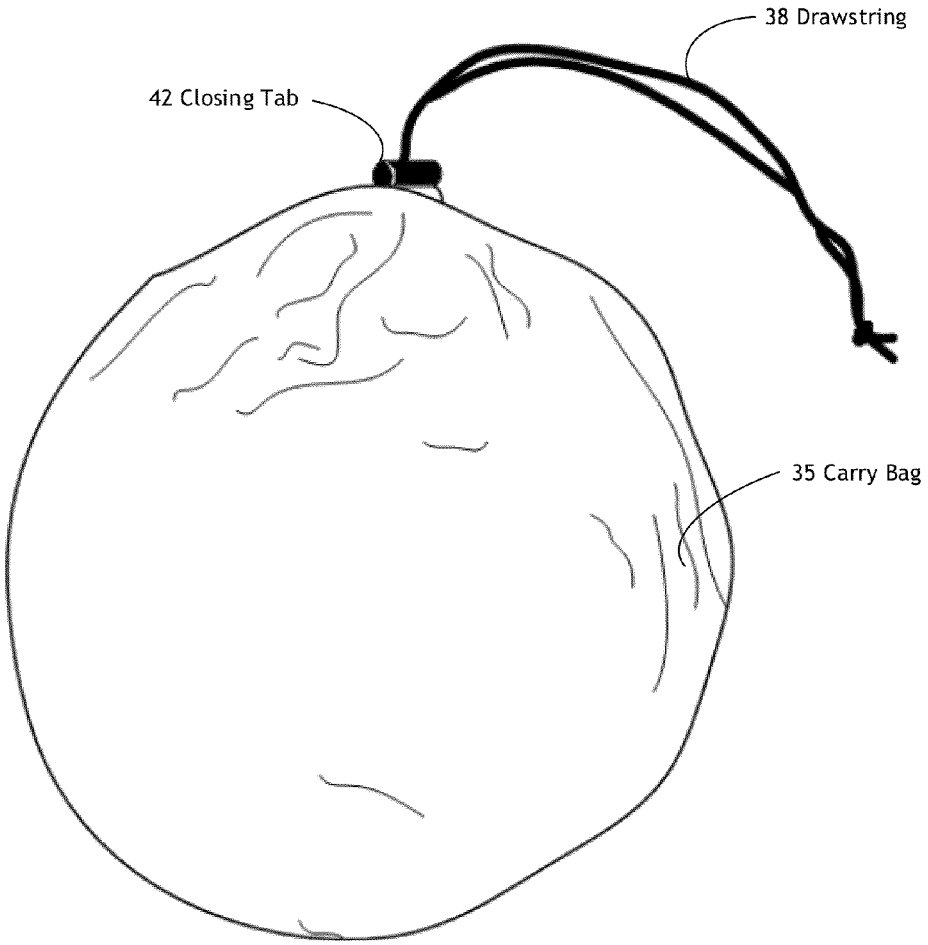
FIG. 8 depicts a carrying bag for storing and transporting the collapsible gaming top of the present invention.

FIG. 8 depicts a carrying bag [35] for storing and transporting the collapsible gaming table top [10] of the present invention. The carrying bag [35] includes a closing tab [42] and a drawstring [38]. The carrying bag [35] can also be used to carry gaming pieces [29]. If the gaming top includes more than one gaming surface, the carrying bag [35] includes sufficient gaming pieces for all gaming surfaces. For storage and transport, the portable gaming top [10] has a carry bag [35], depicted in FIG. 7, which is used to transport portable gaming top in its folded configuration (see FIG. 6C). The carrying bag [35] may have integrated pockets for organizing game accessories, as well as a drawstring [38] and closing tab [42]. The drawstring [38] can be tightened, closing the bag, and the closing tab [42] can take up the excess slack in the drawstring [38], holding the carry bag [35] closed. Alternatively, the carry bag [35] could be closed by other means, such as a flap with hook-and-loop or other fastener.

Figure 9A:
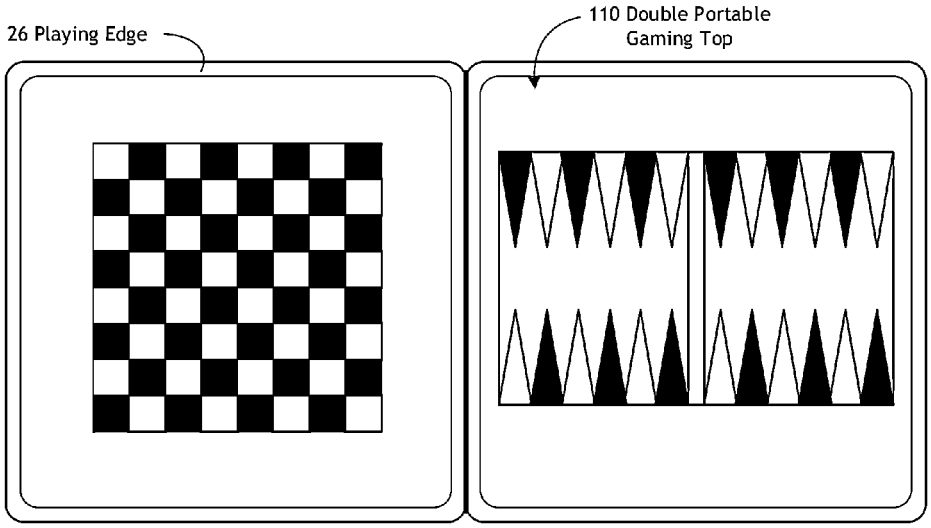
FIGS. 9A and 9B depict yet another preferred embodiment of the portable gaming top of the present invention, comprising two separate gaming surfaces connected to make a larger playing surface.
Figure 9B:
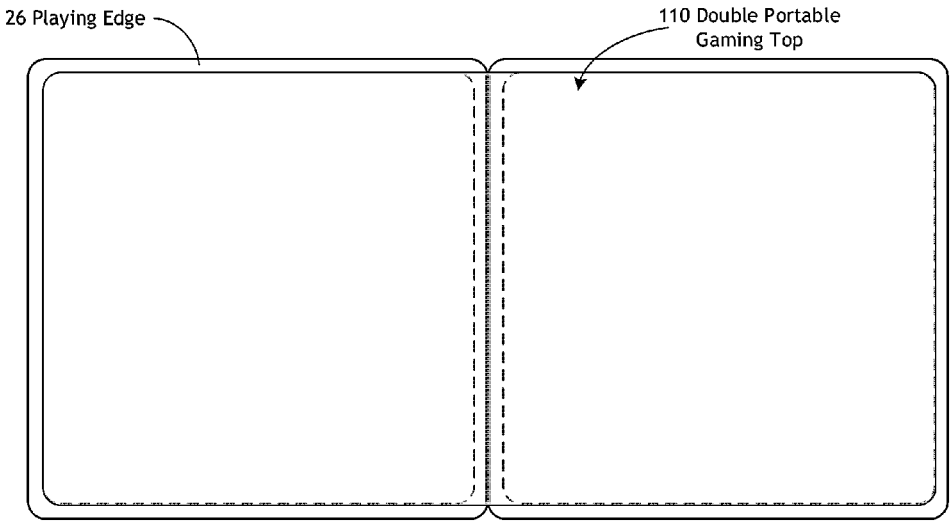
Figure 10:
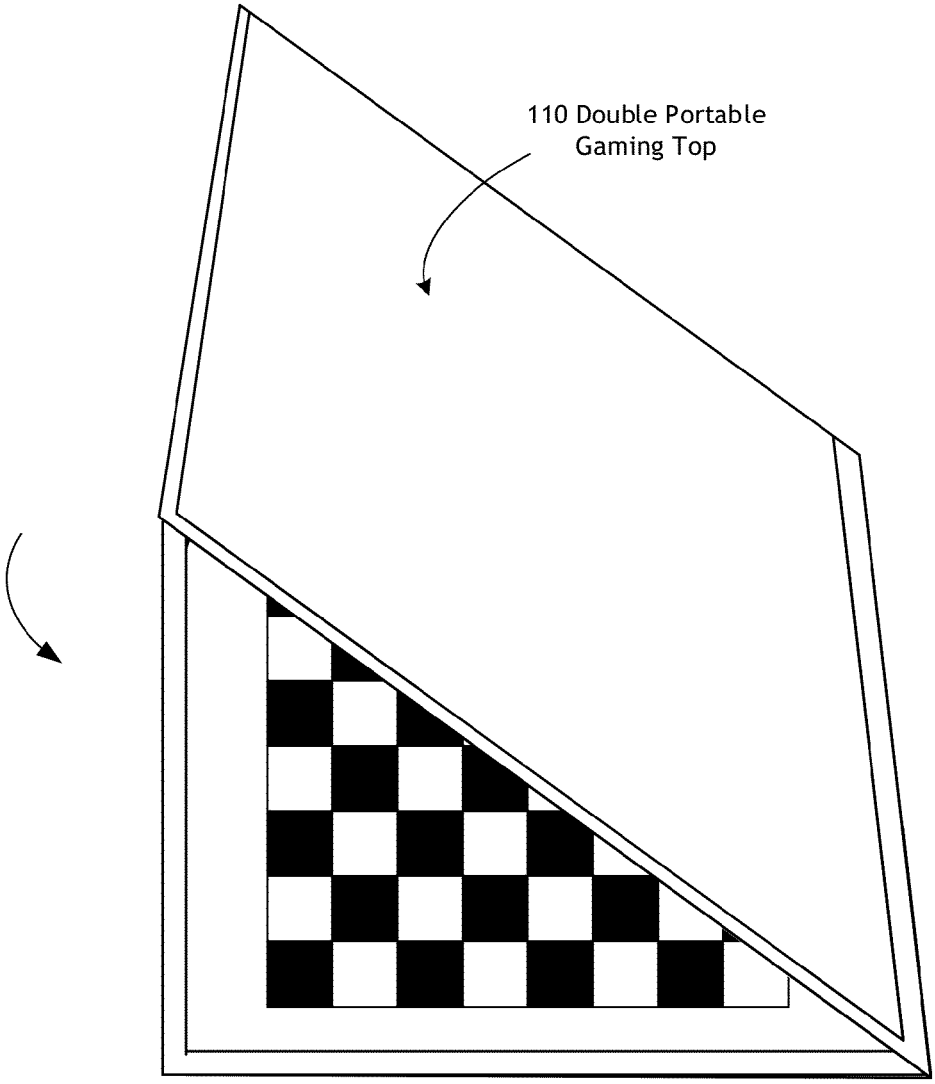
FIG. 10 depicts the portable gaming top of FIG. 9A being folded over onto itself.
Figure 11:
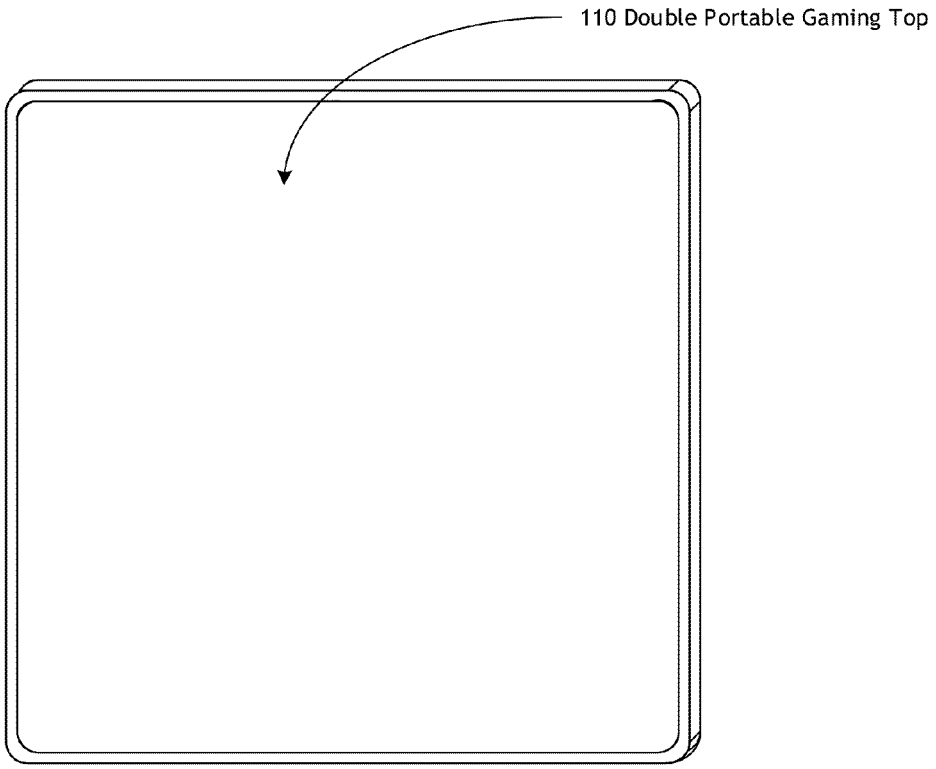
FIG. 11 depicts the portable gaming top of FIG. 9A folded in half.

In but still yet another preferred embodiment, the double gaming top [110] of the present invention also serves the dual purpose as a sunshade for a vehicle. The gaming top [110] is much larger to cover the entire windshield of the vehicle. Accordingly, two or more portable gaming tops are attached to each other, side by side, by a connecting material [115], to form one larger portable gaming top [110]. FIGS. 9A and 9B depict the front and backside of the double gaming top, with the imprinted surfaces being a chess board and a backgammon board. FIG. 10 shows the gaming top [110] being closed much like a book, and FIG. 11 depicts the gaming top [110] closed. In one preferred embodiment, the size and shape of the first gaming top is essentially equal to the size and shape of the second gaming top.

Figure 12:
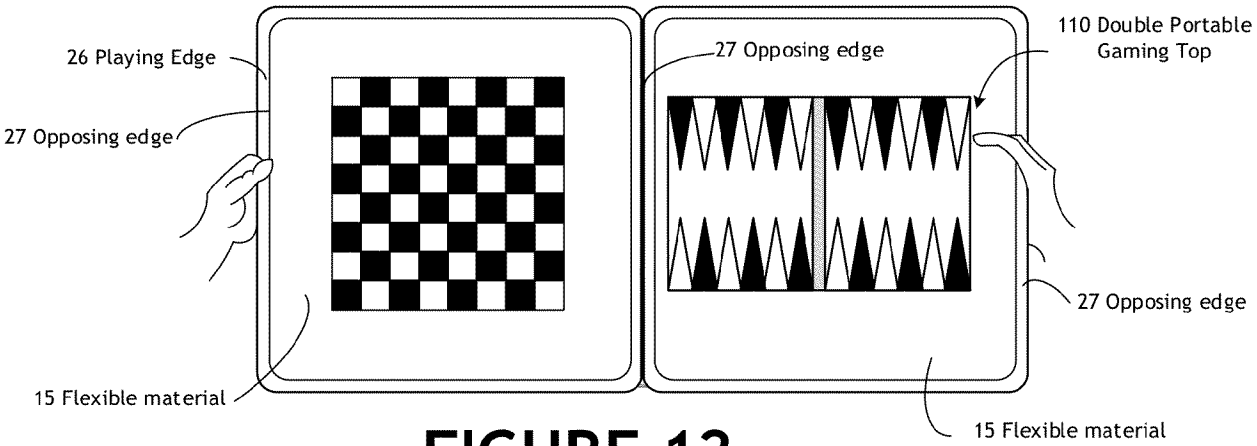
FIG. 12 depicts the portable gaming top of FIG. 9A prior to being collapsed.
Figure 13C:
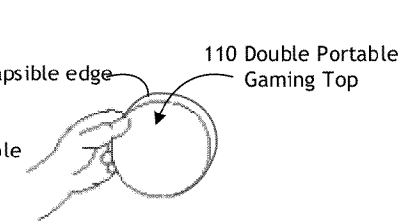
FIGS. 13A, 13B and 13C depict the portable gaming top of FIG. 12 being twisted and collapsed by a user into a small compact shape for storage purposes into a purse or pocket.
Figure 13B:
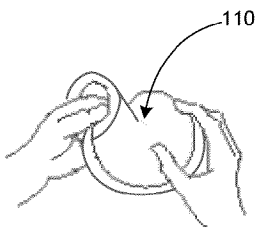
Figure 13A:
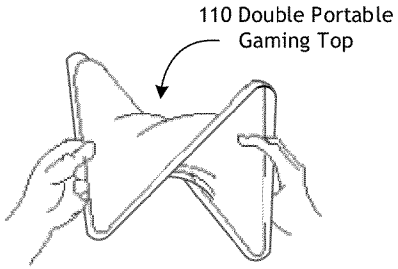

FIG. 12 again depicts the double gaming top [110] of the present invention, the gaming surfaces being a chess board and a backgammon board. Two of said opposing edges [27] of the perimeter [26] are essentially parallel to each other when said perimeter is not collapsed, and the shape of the smaller form factor is essentially circular when said perimeter [28] is collapsed (see FIG. 13C). FIGS. 13A, 13B, and 13C depict the portable gaming top of FIG. 12 being twisted and collapsed by a user into a smaller compact and essentially circular shape for storage purposes into a purse or pocket.

The portable gaming top of the present invention [10] may also have different games imprinted on each side, allowing users to simply flip the top over if a different game is desired. In the case of the double portable gaming top [110], different games can be imprinted on each surface, allowing at least four different games to be played.

The collapsible folding mechanism in the portable gaming top of the present invention [10] and [110] is similar to what is shown in U.S. Pat. No. 5,024,262 (Huang), U.S. Pat. No. 8,342,226 (Zheng), and U.S. Publication No. 20120073770 (Zheng).

The gaming table preferably is in the shape of a polygon, such as a square, rectangle, trapezoid, rhombus, hexagon, octagon, or decagon. However, the shape of the gaming top of the present invention may also be in the shape of a triangle, a pentagon, or some other polygon with an odd number of side edges. The corners may be pointed or rounded or some combination. In addition, the gaming top may include rounded portions combined with linear portions. In the preferred embodiment, two of the opposing edges of the gaming table are essentially parallel to each other.

Different games may be imprinted on the game surface [12]. In the preferred embodiments, the board and table games imprinted on the gaming surface will be in the public domain. These games include chess, checkers, backgammon, dominos, cribbage, bridge, poker, beat-the-dealer, baccarat, and most other card games. Other board and table games are not in the public domain. These games include Monopoly® is a registered trademark of Parker Brothers, Inc., Scrabble® is a registered trademark of Production and Marketing Company, Othello® is a registered trademark of Tsukuda Co., Ltd., and Clue® is a registered trademark of Parker Brothers, Inc., and permission of the trademark owner will be sought.

Throughout this specification, various Patents and Patent Applications are referenced by number and inventor. The disclosures of these Patents/Applications are hereby incorporated by reference in their entireties into this specification in order to more fully describe the state-of-the-art.

It is evident that many alternatives, modifications, and variations of the portable gaming top will be apparent to those skilled in the art in light of the disclosure herein. It is intended that the metes and bounds of the present invention be determined by the appended claim rather than by the language of the above specification, and that all such alternatives, modifications, and variations which form a conjointly cooperative equivalent are intended to be included within the spirit and scope of these claims.

PARTS LIST

10. Portable gaming top
12. Gaming surface
15. Flexible material
17. Strap
22. Suction cup
25. Reflective surface
26. Playing edge
27. Opposing edges
28. Collapsed edge
29. Gaming piece
32. Game accessory holder
35. Carry bag
38. Drawstring
42. Closing tab
110. Double portable gaming top
115. Connecting material

I claim:

1. A gaming top comprising:

a. a first imprinted gaming surface on a first top surface of said gaming top device; a first perimeter strip of first spring-like material surrounding said first top surface, said first perimeter strip of first spring-like material having a first larger form factor structure, said first perimeter strip of first spring-like material of said first larger form factor structure having a first larger shape and first opposing edges, two of said first opposing edges of said first larger form factor structure being parallel, said first perimeter strip of first spring-like material being collapsible into a first smaller form factor structure, said first perimeter strip of first spring-like material having a first smaller form factor structure, said first perimeter strip of first spring-like material of said first smaller form factor structure having a first smaller shape, said first smaller shape being a first circle; and a first flexible material being stretched across said first perimeter strip of first spring-like material, said first perimeter strip of first spring-like material being twistable and collapsing into said first smaller form factor structure; and b. a second imprinted gaming surface on a second top surface of said gaming top device; a second perimeter strip of second spring-like material surrounding said second top surface, said second perimeter strip of second spring-like material having a second larger form factor structure, said second perimeter strip of second spring-like material of said second larger form factor structure having a second larger shape and second opposing edges, two of said second opposing edges of said second larger form factor structure being parallel, said second perimeter strip of second spring-like material being collapsible into a second smaller form factor structure, said second perimeter strip of second spring-like material having a second smaller form factor structure, said second perimeter strip of second spring-like material of said second smaller form factor structure having a second smaller shape, said second smaller shape being a second circle; and a second flexible material being stretched across said second perimeter strip of second spring-like material, said second perimeter strip of second spring-like material being twistable and collapsing into said second smaller form factor structure; and c. a connecting material attaching said first imprinted gaming top surface to said second imprinted gaming surface, side-by-side, enabling said first imprinted gaming surface and said second imprinted gaming surface to close like a book.

2. The gaming top device of claim 1, wherein said first perimeter strip of spring-like material is a plastic or metal.

3. The gaming top device of claim 1, further comprising at least one fixing means to secure said gaming top device to another surface.

4. The gaming top device of claim 1, wherein said gaming top device also functions as a vehicle sunshade.

5. The gaming top device of claim 1, wherein said first imprinted gaming surface including features to enhance play of a game.

6. The gaming top device of claim 1, wherein said first smaller form factor fits into a purse or pocket.

7. The gaming top device of claim 1, wherein said first perimeter of said first form factor has a generally square or rectangular shape with rounded corners.

8. The gaming top device of claim 7, wherein said second perimeter of said second form factor has a generally square or rectangular shape with rounded corners.

* * * * *